US006657114B2

(12) United States Patent
Iwamoto

(10) Patent No.: US 6,657,114 B2
(45) Date of Patent: Dec. 2, 2003

(54) APPARATUS AND METHOD FOR GENERATING ADDITIONAL SOUND ON THE BASIS OF SOUND SIGNAL

(75) Inventor: Kazuhide Iwamoto, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/797,120

(22) Filed: Mar. 1, 2001

(65) Prior Publication Data

US 2001/0037196 A1 Nov. 1, 2001

(30) Foreign Application Priority Data

Mar. 2, 2000 (JP) ..... 2000-057111

(51) Int. Cl.[7] ..... G10H 1/36; G10H 7/00

(52) U.S. Cl. ..... 84/610; 84/616; 84/619; 434/307 A

(58) Field of Search ..... 84/610, 616, 619, 84/634, 654, 657; 434/307 A

(56) References Cited

U.S. PATENT DOCUMENTS 5,446,238 A 8/1995 Koyama et al.
5,719,346 A * 2/1998 Yoshida et al. ..... 434/307 A
5,770,813 A * 6/1998 Nakamura ..... 84/610
5,939,654 A * 8/1999 Anada ..... 434/307 A
6,307,140 B1 * 10/2001 Iwamoto ..... 84/622

FOREIGN PATENT DOCUMENTS

JP 11-054420 3/1999

* cited by examiner

*Primary Examiner*—Jeffrey Donels
(74) *Attorney, Agent, or Firm*—Morrison & Foerster LLP

(57) ABSTRACT

Sound signal indicative of a human voice or musical tone is input, and the pitch of the input sound signal is detected. Then, a scale note pitch is determined which is nearest to the detected pitch of the input sound signal. In the meantime, a scale note pitch of an additional sound or harmony sound to be added to the input sound is specified in accordance with a harmony mode selected by a user. The scale note pitch of the additional sound to be generated is modified in accordance with a difference between the determined scale note pitch and the detected pitch of the input sound signal. Because the additional sound is generated with the modified pitch, it can appropriately follow a variation in the pitch of the input sound to be in harmony with the input sound, rather than exactly agreeing with the scale note pitch. As another example, reference scale note pitch data may be supplied, instead of the scale note pitch nearest to the detected pitch of the input sound signal being determined in the above-mentioned manner.

19 Claims, 9 Drawing Sheets

| HARMONY MODE | HARMONY TYPE |
|---|---|
| VOCODER HARMONY MODE | NO TRANSPOSE |
| | AUTO. TRANSPOSE |
| | −3− OCTAVE TRANSPOSE |
| | −2− OCTAVE TRANSPOSE |
| | −1− OCTAVE TRANSPOSE |
| | +1− OCTAVE TRANSPOSE |
| | +2− OCTAVE TRANSPOSE |
| | +3− OCTAVE TRANSPOSE |

(PRIOR ART)

FIG. 11

| DETUNE HARMONY MODE | | |
|---|---|---|
| HARMONY TYPE | VOICE 1 | VOICE 2 |
| TrioLow | −7CENT | +7CENT |

(PRIOR ART)

FIG. 12

| CHROMATIC HARMONY MODE | | |
|---|---|---|
| HARMONY TYPE | VOICE 1 | VOICE 2 |
| TrioLow | ONE OCTAVE LOWER | − |
| OctaveAbove | ONE OCTAVE HIGHER | − |

(PRIOR ART)

FIG. 13

| CHORDAL HARMONY MODE | | |
|---|---|---|
| HARMONY TYPE | ONE VOICE | TWO VOICES |
| DUET ABOVE | ONE VOICE UPPER | — |
| DUET BELOW | ONE VOICE LOWER | — |
| DUET ABOVE + BASS | ONE VOICE BASS | ONE VOICE UPPER |
| TRIO ABOVE | ONE VOICE UPPER | ONE VOICE UPPER |
| TRIO ABOVE & BELOW | ONE VOICE LOWER | ONE VOICE UPPER |
| TRIO BELOW | ONE VOICE LOWER | ONE VOICE LOWER |
| DUET ABOVE + OCTAVE ABOVE | ONE VOICE UPPER | ONE VOICE UPPER |
| DUET BELOW + BASS | ONE VOICE BASS | ONE VOICE LOWER |
| DUET BELOW + OCTAVE BELOW | ONE VOICE LOWER | ONE VOICE LOWER |
| DIATONIC ABOVE | ONE VOICE UPPER | ONE VOICE UPPER |
| DIATONIC ABOVE & BELOW | ONE VOICE LOWER | ONE VOICE UPPER |
| DIATONIC BELOW | ONE VOICE LOWER | ONE VOICE LOWER |
| JAZZ ABOVE | ONE VOICE UPPER | ONE VOICE UPPER |
| JAZZ ABOVE & BELOW | ONE VOICE LOWER | ONE VOICE UPPER |
| JAZZ BELOW | ONE VOICE LOWER | ONE VOICE LOWER |
| UNISON | ONE VOICE SAME | OCTAVE SHIFT |
| 3 UNISON | OCTAVE SHIFT | OCTAVE SHIFT |

FIG. 14

APPARATUS AND METHOD FOR GENERATING ADDITIONAL SOUND ON THE BASIS OF SOUND SIGNAL

BACKGROUND OF THE INVENTION

The present invention relates to an improved apparatus and method for generating an additional sound on the basis of a sound signal representative of a human voice or musical tone, and a storage medium containing a processing program for generating such an additional sound.

There has been known, from Japanese Patent Laid-open Publication No. HEI-11-133990 or the like, a technique for detecting, in real time, a pitch of a vocal signal input by a user (i.e., a user-input vocal signal), modifying the detected pitch of the input vocal signal to generate a harmony sound signal in accordance with a predetermined harmony mode, and then combining the harmony sound signal with the original input vocal signal to thereby output the combined result through speakers. Examples of the predetermined harmony mode used for such a purpose include a "vocoder harmony mode", "chordal harmony mode", "detune harmony mode" and "chromatic harmony mode".

FIG. 11 is a diagram explanatory of various types of harmonies attainable when the conventionally-known technique operates in the vocoder harmony mode. The vocoder harmony mode is a mode in which playing a key in a specific key region of a keyboard performance operator section, selected as a harmony part, simultaneously with input of a human voice can generate a harmony sound (i.e., harmony note) with a vocal character of the input voice and with a pitch corresponding to a scale note pitch of the played key on the keyboard performance operator section. The harmony part that can be designated here is not necessarily limited to the right-hand (UPPER) key region or left-hand (LOWER) key region of the keyboard performance operator section, and can also be selected by a user from among an automatic performance song track, external input or the like. Depending on the harmony type designated, the harmony sound to be generated is octave-shifted from the scale note pitch of the harmony part, or shifted from the scale note pitch of the harmony part to within one octave about the pitch of the input voice (auto transpose), or the like.

FIG. 12 is a diagram explanatory of a type of harmony attainable when the conventionally-known technique operates in the detune harmony mode, which is a mode intended to impart a chorus effect by generating a harmony sound slightly shifted in pitch from an input voice. Scale note pitch of the harmony sound is governed by the input voice and amount of the detune. Although only one type of harmony is shown in the figure, a plurality types of harmonies can be set in the detune harmony mode by changing the detune amount.

FIG. 13 a diagram explanatory of types of harmonies attainable when the conventionally-known technique operates in the chromatic harmony mode, which is a mode intended to generate a harmony sound shifted in pitch from an input voice by a predetermined interval. In this case too, the scale note pitch of the harmony sound is governed by the input voice and amount of the pitch shift. The pitch shift amount is varied in accordance with a switch between the harmony types.

Further, FIG. 14 a diagram explanatory of types of harmonies attainable when the conventionally-known technique operates in the chordal harmony mode. The chordal harmony mode is a mode in which a type of a chord designated by a key in an automatic accompaniment chord key region of the keyboard performance operator section is identified and then one or more harmony sounds are generated in accordance with the identified chord type and with pitches corresponding to a pitch of an input voice. In this mode, only inputting the voice can generate harmony sounds corresponding to the designated chord type. In the chordal harmony mode, 37 different chord types as defined in the MIDI specifications are identifiable, and the pitches of the harmony sounds are determined in accordance with the harmony type, identified chord type and a scale note pitch (vocal note) nearest to the pitch of the input voice.

Throughout this patent specification, the terms "scale note pitch" are used to refer to a pitch corresponding to one of note names on a chromatic scale (12 notes per octave), and it is assumed that pitch frequencies are predefined in half steps or semitones. The note names are also called "note codes" in the MIDI specifications and allotted unique numbers "0"–"127" (with note name "C4" allotted number "60"). However, in some cases, the pitch frequencies corresponding to the note names are associated with frequencies shifted from the absolute frequencies where note name "A4" is 440 Hz, or the pure temperament (just intonation) system is employed rather than the temperament system.

In the chordal harmony mode, there can be produced a variety of harmony sounds by switching between the harmony types. Selection can be made between "one voice" and "two voice", and harmony sounds of different scale note pitches, one above the input voice pitch and the other below the input voice pitch, can be designated. Also, "one voice bass" represents a harmony sound having, as its scale note pitch, a root note of a designated chord. In "unison", selection is made from among harmony sounds of a scale note pitch agreeing with the pitch of the input voice and pitches higher and lower than the input voice pitch by one or more octaves.

In the above-mentioned detune harmony mode or chromatic harmony mode, the harmony sound is set to a scale note pitch detuned or shifted from the pitch of the input vocal signal (vocal pitch). Thus, by detuning or pitch-shifting from the vocal pitch itself, there can always be maintained a proportional relationship in pitch frequency between the input voice and the harmony sound. In the above-mentioned vocoder harmony mode and chordal harmony mode, on the other hand, each harmony sound is set to a scale note pitch corresponding to a pitch designated by operation of a keyboard key or by designation of a chord. The scale note pitch is predefined in half steps. Namely, in the vocoder harmony mode, the harmony sound is imparted with a pitch corresponding to a scale note pitch of the harmony part, or a pitch transposed by octave from the scale note pitch of the harmony part pitch. Further, in the chordal harmony mode, scale note pitches are designated for the harmony sounds in accordance with the scale note pitch nearest to the pitch of the input voice and designated chord, and then the harmony sounds are imparted with pitches corresponding to the designated scale note pitches and predefined in half steps.

SUMMARY OF THE INVENTION

According to a first aspect of the present invention, there is provided an apparatus for generating an additional sound signal on the basis of an input sound signal, which comprises: an input device adapted to receive control information for controlling a pitch of an additional sound; and a processor device coupled with the input device. The processor device is adapted to: obtain pitch information of the input sound signal; obtain, on the basis of at least the control information received via the input device, scale note pitch information of an additional sound to be generated; determine a scale note pitch nearest to a pitch indicated by the pitch information of the input sound signal; modify, in accordance with a difference between the determined scale note pitch and the pitch of the input sound signal, a pitch indicated by the scale note pitch information of the additional sound to be generated; and generate an additional sound signal with the modified pitch.

According to a second aspect of the present invention, there is provided an apparatus for generating an additional sound signal on the basis of an input sound signal, which comprises: a data supply section adapted to supply scale note pitch data varying over time; an input device adapted to receive control information for controlling a pitch of an additional sound; and a processor device coupled with the data supply section and the input device, the processor device being adapted to: obtain pitch information of the input sound signal; obtain, on the basis of at least the control information received via the input device, scale note pitch information of an additional sound to be generated; modify, in accordance with a difference between a pitch indicated by the pitch information of the input sound signal and a pitch indicated by the scale note pitch data supplied by the data supply section, a pitch indicated by the scale note pitch information of the additional sound to be generated; and generate an additional sound signal with the modified pitch.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, rather than a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIG. 11 is a diagram explanatory of various types of harmonies when a conventionally-known technique operates in a vocoder harmony mode;

FIG. 12 is a diagram explanatory of a type of harmony when the conventionally-known technique operates in a detune harmony mode;

FIG. 13 a diagram explanatory of types of harmonies when the conventionally-known technique operates in a chromatic harmony mode; and FIG. 14 a diagram explanatory of types of harmonies when the conventionally-known technique operates in a chordal harmony mode.

DETAILED DESCRIPTION OF EMBODIMENTS

Figure 1:
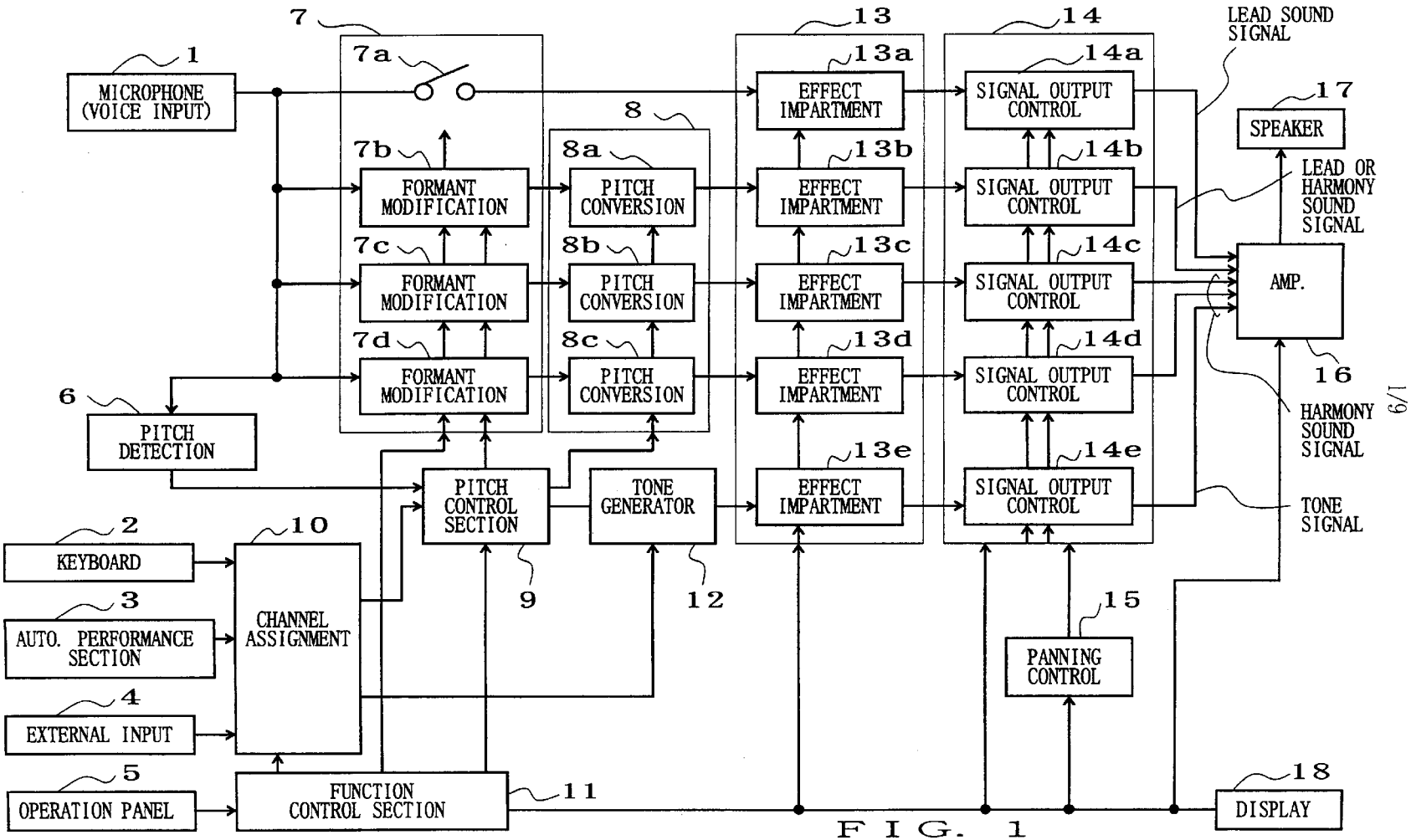
FIG. 1 is a functional block diagram explanatory of an apparatus for processing a vocal signal or tone signal in accordance with one embodiment of the present invention.

Before proceeding to detailed description of the invention, one embodiment according to a first aspect of the present invention is outlined below. Namely, an apparatus for generating an additional sound signal on the basis of an input sound signal includes an input device adapted to receive control information for controlling the pitch of the additional sound, and a processor device coupled with the input device. The processor device is adapted to: obtain pitch information of the input sound signal; obtain, on the basis of at least the received control information, scale note pitch information of an additional sound to be generated; determine a scale note pitch nearest to the pitch indicated by the pitch information of the input sound signal; modify, in accordance with a difference between the determined nearest scale note pitch and the pitch of the input sound signal, the pitch indicated by the scale note pitch information of the additional sound to be generated; and generate an additional sound signal having the modified pitch. With such arrangements, the additional sound signal can be generated at a pitch that is variable in accordance with the difference between the pitch of the input sound signal and the scale note pitch nearest thereto, rather than exactly at a predetermined scale note pitch. Thus, in the case where the input sound signal is of a human voice, the pitch of the additional sound, i.e., harmony sound, is allowed to vary in the track of variation in the pitch of the human voice.

However, the above-discussed conventionally-known technique is unable to afford such benefits. Namely, pitches of input voices (vocal pitches) do not always fit predefined pitches corresponding to scale note pitches. More specifically, when a user sings with non-stable or other incorrect pitches, the pitches of input voices would deviate from the predefined pitches corresponding to the scale note pitches. Thus, if harmony sounds of predefined scale note pitches are imparted to the input singing voices of the user as in the conventionally-known technique, there would occur some undesired "muddiness" in the harmony sounds that should be audibly produced in harmony with the input voices. As an approach for avoiding such muddiness in the harmony sounds, it has also been known to correct the pitches of the input voices and audibly produce or sound the pitch-corrected voices as lead sounds; this approach can secure appropriate harmony between the input voices and harmony sounds because the input voices are also corrected to pitches predefined in half steps or semitones. However, the known approach would present the problem that subtle pitch deviations in the user's singing voices are no longer reflected in the lead and harmony sounds. In the detune harmony mode or chromatic harmony mode as explained above, even the above-discussed conventionally-known technique can secure appropriate harmony between the input voices and the harmony sounds with the subtle pitch deviations of the input voices left unremoved, if notes shifted a predetermined amount from the vocal pitches are used as the harmony sounds. However, because the lead sounds and the harmony sounds do always maintain a given pitch difference therebetween even though the melody of the song varies over time, the harmony sounds tend to lack variety.

The embodiment of the present invention described herein can provide good solutions to the aforesaid problems of the conventionally-known technique; that is, they can generate additional sound signals rich in variations while securing appropriate harmony between the additional sound signals and the additional sound signals.

Further, another embodiment according to a second aspect of the present invention is outlined below. Namely, an apparatus for generating an additional sound signal on the basis of an input sound signal includes a data supply section adapted to supply scale note pitch data varying over time, an input device adapted to receive control information for controlling the pitch of the additional sound, and a processor device coupled with the data supply section and input device. The processor device is adapted to: obtain pitch information of the input sound signal; obtain, on the basis of at least the received control information, scale note pitch information of an additional sound to be generated; modify, in accordance with a difference between the pitch indicated by the pitch information of the input sound signal and the scale note pitch indicated by the scale note pitch data supplied from the data supply section, the pitch indicated by the scale note pitch information of the additional sound; and generate an additional sound signal having the modified pitch. Thus, in a similar manner to the above-mentioned, the apparatus can generate additional sound signals which have pitches appropriately harmonized with those of the input sound signals and are also rich in variations similarly to pitch variations of input sound signals as found in human voices. Further, by supplying time-varying scale note pitch data, this embodiment can dispense with the process, employed in the embodiment of the first-aspect invention, for determining a scale note pitch nearest to the pitch indicated by the pitch information of the input sound signal. For example, the scale note pitch data may be standard scale note pitch data based on a melody of a song. In such a case, tones based on the scale note pitch data may be audibly produced or sounded as standards for the song's melody.

As an example, the additional sound signals may be generated with waveform characteristics identical to or similar to those of input sound signals. In this way, it is possible to produce harmony sounds which are well harmonized in the waveform characteristics, i.e., vocal character, with the input sound signals and thus are pleasing to the ear of every listener.

Now, various specific embodiments of the present invention will be described more fully with reference to the accompanying drawings.

FIG. 1 is a functional block diagram explanatory of an apparatus for processing a vocal signal or tone signal (vocal signal/tone signal processing apparatus) in accordance with one embodiment of the present invention. The processing apparatus includes a microphone 1 functioning as a voice input section, a keyboard performance operator section 2 for generating performance data in response to depression of a key, an automatic performance section 3 where performance data stored in memory are read out for an automatic performance, an external input section 4 for receiving MIDI (Musical Instrument Digital Interface) signals etc. from an external source, an operation panel 5 via which necessary functions and parameters can be set, and a pitch detection section 6 for detecting a pitch of each input voice (vocal pitch). Any desired one of various harmony modes such as shown in FIGS. 11 to 14 can be selected or designated on the basis of manipulation on the operation panel 5, data received via the external input section 4, performance data read out via the automatic performance section 3, and/or the like.

The vocal signal/tone signal processing apparatus of FIG. 1 also includes a formant modification unit 7 for controlling the vocal character of the input voice. The formant modification unit 7 includes, for example, a control switch 7*a* for performing control to allow or to not allow the input voice to pass as it is, a first formant modification section 7*b* for modifying the formants of a lead sound or a harmony sound, and second and third formant modification sections 7*c* and 7*d* for modifying the formants of a harmony sound. In some case, the first to third formant modification sections 7*b* to 7*d* are all deactivated so as not to make the formant modification. For example, when the formants of the lead sound should be modified, while the control switch 7*a* is turned off, the first formant modification section 7*b* is used for modifying the formants of the lead sound.

Reference numeral 8 represents a pitch conversion unit 8 for converting the pitch of the input voice, which includes first to third pitch conversion sections 8*a* to 8*c*. For example, the first pitch conversion section 8*a* converts the pitch of either one of the lead sound and harmony sound, and the second and third pitch conversion sections 8*b* and 8*c* each convert the pitch of the harmony sound.

The processing apparatus of FIG. 1 further includes a pitch control section 9 for controlling the pitch output from the pitch conversion unit 8 and tone generator section 12 on the basis of the pitch of the input voice output from the pitch detection section 6 and performance data output from a channel assignment section 10. The channel assignment section 10 selectively assigns control information passed from the keyboard performance operator section 2, automatic performance section 3, external input section 4, etc. as control inputs to the pitch control section 9 and tone generator section 12. Reference numeral 11 represents a function control section for controlling various functions of the processing apparatus. The tone generator section 12 generates tone signals.

The vocal signal/tone signal processing apparatus further includes an effect impartment unit 13 including first to fifth effect impartment sections 13*a* to 13*e*. For example, the first effect impartment section 13*a* imparts an effect to the lead sound, the second effect impartment section 13*b* imparts an effect to either one of the lead sound and harmony sound, the third and forth effect impartment sections 13*c* and 13*d* impart an effect to the harmony sound, and the fifth effect impartment section 13*e* imparts an effect to a tone. Using switches provided on the operation panel 5, it is possible to impart a desired effect to each type of input signal in a simplified and prompt manner.

The processing apparatus further includes a signal output control unit 14 that is controlled by the function control section 11. The signal output control unit 14 includes first to fifth signal output control sections 14*a* to 14*e*, of which the first signal output control section 14*a* controls the volume ratio of the lead sound, the second signal output control section 14*b* controls the volume ratio of either one of the lead sound and harmony sound, the third and fourth signal output control section 14*c* and 14*d* control the volume ratio of the harmony sound, and the fifth signal output control section 14*e* controls the volume ratio of the tone. The signal output control unit 14 also performs control, for each of the sound and tone signals, as to whether or not to audibly output the sound or tone signal. Harmony sound signal is normally output after being combined with the lead sound signal from the signal output control section 14*a* or 14*b*, but it also can be output singly without being combined with the lead sound signal.

Further, reference numeral 15 represents a panning control section, and 16 an amplification section for mixing and amplifying the outputs from the first to fifth signal output control sections 14*a* to 14*e* so as to output stereo or 3D (three dimensional) vocal or tone signals. Reference numeral 17 represents one or more speakers, and 18 a display device, such as a liquid crystal display (LCD) device, provided on the operation panel 5.

Note that the illustrated example of FIG. 1 includes four vocal harmony parts. Assignment of the vocal harmony parts can be set via the operation panel 5, controlled by the function control section 11, and effected by the channel assignment section 10.

The following paragraphs describe general operation of the embodiment of FIG. 1. The input voice from the microphone is passed to the formant modification unit 7 and pitch detection section 6. In the illustrated example, the formant modification unit 7 can process the input voice through four channels or less: one channel through which the input voice is output directly as received from the microphone 1; and three other channels through which the input voice is output after the formant modification (a case where the input voice is not subjected to the formant modification through any of the three channels is also possible). When the switch section 7*a* is turned off to prevent the input voice from being output directly as received from the microphone 1, the first formant modification section 7*b* modifies the formants of the lead sound, in which case the harmony sound is output through two channels of second and third formant modification sections 7*c*, 7*d*.

The outputs of the first to third formant modification sections 7*b* to 7*d* are delivered to the first to third pitch conversion sections 8*a* to 8*c*, respectively. The output of the switch section 7*a*, outputs of the first to third pitch conversion sections 8*a* to 8*c* and output of the tone generator section 12 are imparted with effects by the first to fifth effect impartment sections 13*a* to 13*e*, respectively. Further, the first to fifth signal output control sections 14*a* to 14*e* operate to output signals of only one or more specific channels, and sets respective localization of the signals of the individual channels on the basis of weighting control performed by the weighting control section 15. The output of the first signal output control section 14*a* is provided as a lead sound signal, output of the second signal output control section 14*b* is provided as either a lead sound signal or a harmony sound signal, outputs of the third and fourth signal output control sections 14*c* and 14*d* are provided as harmony sound signals, and output of the fifth signal output control section 14*e* is provided as a tone signal. All of these signals are mixed together by the amplifier 16 and then sounded via the speakers 17.

The pitch detection section 6 detects the vocal pitch using the zero-crossing detection scheme or other technique known in the field of sound analysis, and then outputs the detected vocal pitch to the pitch control section 9. The pitch control section 9 determines every converted or modified pitch of every harmony sound in accordance with the selected or designated harmony mode, and passes the determined pitch information to the pitch conversion unit 8, formant modification unit 7, tone generator section 12, effect impartment unit 13, etc.

The pitch conversion may be performed by a conventionally-known scheme that converts the pitch while still retaining the formants of the input waveform, as will be briefed below. Namely, a segment of the input waveform is extracted every predetermined period using a window function, and the thus-extracted waveform segments are arranged in a sequential fashion. By performing such operations through two channels in a parallel fashion so that the waveform segment extraction is initiated alternately in the two channels, it is also possible to obtain an output waveform having a pitch frequency higher than the pitch of the input signal. At that time, the width of the window functions is set to less than two times the output period so that the successive window functions do not overlap with each other.

By varying the waveform readout rate during the pitch-converting waveform segment extraction so as to change the waveform shape itself, the formants can be modified; this formant modification allows the quality or vocal character of the input voice, e.g., from a male voice to a female voice or vice versa.

The pitch control section 9 also has a function of automatically changing the type of an effect (including a vocal character) to be imparted to the harmony sound and/or automatically changing the degree or depth of the effect in accordance with a difference between the pitches before and after the pitch conversion, i.e., the input vocal pitch and the converted pitch of the harmony sound, by controlling the formant modification unit 7 and effect impartment unit 13. As a result, it is possible to automatically impart an appropriate effect, rich in variations, to each harmony sound in accordance with a difference in pitch between the user-input voice and the harmony sound.

The channel assignment section 10 allocates input performance data from any one of the keyboard performance operator section 2, automatic performance section 3 and external input section 4 to the harmony parts to provide the performance data to the pitch control section 9 and assigns other input performance data to a tone generating channel so as to control the pitch etc. of a tone to be generated by the tone generator section 12.

Via the function control section 11, the output data from the operation panel 5 controls the respective functions of the formant modification unit 7, pitch control section 9, channel assignment section 10, tone generator section 12, effect impartment unit 13, signal output control unit 14, panning control section 15, amplifiers 16, display device 18, etc.

With the above-described arrangements, the lead sound corresponding to the vocal signal input via the microphone 1 and at least a selected one of the harmony sound and tone created on the basis of the input voice can be mixed and sounded after being imparted respective effects as desired. Among examples of the effects to be imparted are gender (type and depth of a vocal character such as a male voice, female voice or intermediate between the male and female voice), vibrato, tremolo, volume, panning (localization), detune (detune of the harmony sound in other modes than the later-described detune harmony mode), reverberation, chorus, etc.

Although, in the illustrated example of FIG. 1, the effect impartment is shown as being performed by the effect impartment section 13 to facilitate the understanding of the functions, the functions related to the pitch conversion, such as the vibrato and detune effect impartment, may be performed simultaneously with the pitch conversion by the pitch conversion unit 8. Further, the volume and panning effect impartment is performed by the signal output control unit 14, and the gender effect impartment is controlled by the formant modification unit 7.

Also, note that the operation panel 5 and function control section 11 are arranged in such a way that the effect to be imparted to the user-input vocal signal (lead sound) and effect to be imparted to the harmony sound can be set thereby independently of each other.

The number of output channels for the lead sound signal and the number of output channels for the harmony sound signal may both be set as desired. The lead sound may be delivered to the first signal output control section 14*a* without being subjected to the formant modification and effect impartment process. The first formant modification section 7*b*, second effect impartment section 13*b* and second signal output control section 14*b* may be dedicated only to lead sound signal processing. The signal output control unit 14 can select the output channel for the lead sound signal and one or more of the output channels for a plurality of the harmony sound signals and tone signal, to pass the lead sound signal and harmony sound signal or tone signal to the amplifiers 16 for audible production or sounding.

Note that illustration of A/D and D/A converters is omitted in the functional block diagram of FIG. 1 because no distinction is made between the analog signal processing and the digital signal processing for simplicity of illustration and description. For example, the analog vocal signal output from the microphone 1 is first converted via an A/D converter into digital representation and then supplied to the succeeding function block. Further, the signal output control unit 14 digitally adds together the signals of the plurality of channels after weighting and then outputs the added result to the amplifier 16 via a D/A converter. Of course, a recorded analog or digital vocal (or other sound) signal can be input to the unit 7 instead of the output of the microphone 1.

Input voice from the microphone 1 or the like is passed through the formant modification unit 7 to the pitch conversion unit 8, where the input voice is converted to a pitch (predefined in half steps) corresponding to a scale note pitch of a designated harmony sound so as to change into a harmony sound. Therefore, the pitch of the harmony sound (harmony note) generated on the basis of the input voice is one of the chromatic scale note pitches defined in half steps. As a consequence, the pitches of the input voice and harmony sound do not present a constant frequency ratio and thus can not harmonize with each other. Thus, in a situation where the detected pitch of the input voice deviates from any of the scale note pitches, the instant embodiment modifies the pitch of the harmony sound to deviate from the corresponding predefined pitch similarly to the input voice. Pitch of the harmony sound to be generated may be designated in the harmony part as in the conventional technique. Namely, depending on the selected or designated harmony mode, a tone pitch of a key manually played on the keyboard performance operator section 2 may be designated as the scale note pitch of the harmony sound, or one or more tone pitches corresponding to a chord manually played on the keyboard performance operator section 2 may be designated as the scale note pitch of one or more harmony sounds. In an alternative, a tone pitch corresponding to performance data reproduced by automatic performance may be designated as the scale note pitch of the harmony sound.

Figure 2:
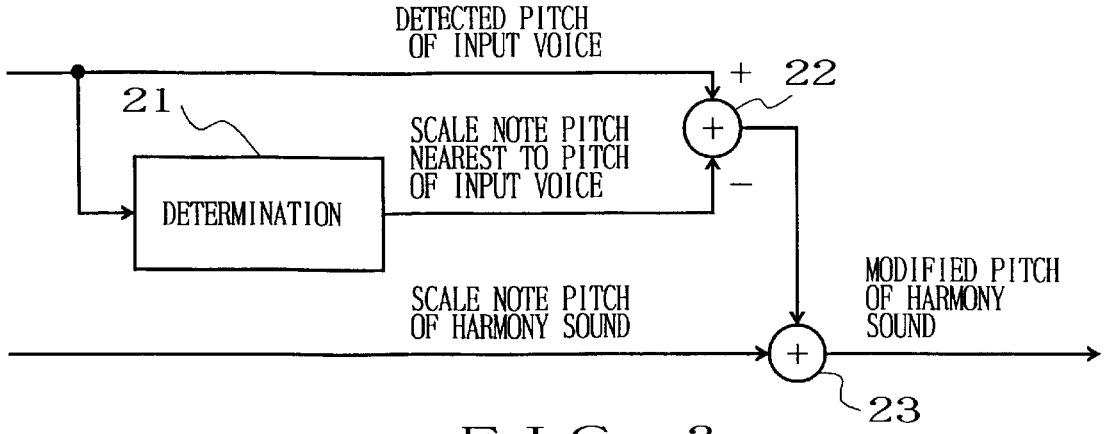
FIG. 2 is a diagram explanatory of an example of a process for determining a pitch of a harmony sound in accordance with a first embodiment of the present invention.

FIG. 2 is a diagram explanatory of an example of a process for generating the pitch of the harmony sound in accordance with a first embodiment of the present invention. This process is carried out within the pitch conversion section 9. Determination section 21 determines one of the scale note pitches which is nearest to the detected pitch of the input voice. Subtracter 22 calculates a difference between the detected pitch of the input voice and the determined nearest scale note pitch. Adder 23 adds, to the scale note pitch of the harmony sound, the pitch difference calculated by the subtracter 22. Each of the pitches is expressed here using a logarithmic value of frequency, such as cents. Thus, in each arithmetic operation using an actual frequency, addition/subtraction is replaced by multiplication/division; namely, a difference corresponds to a ratio.

Figure 3:
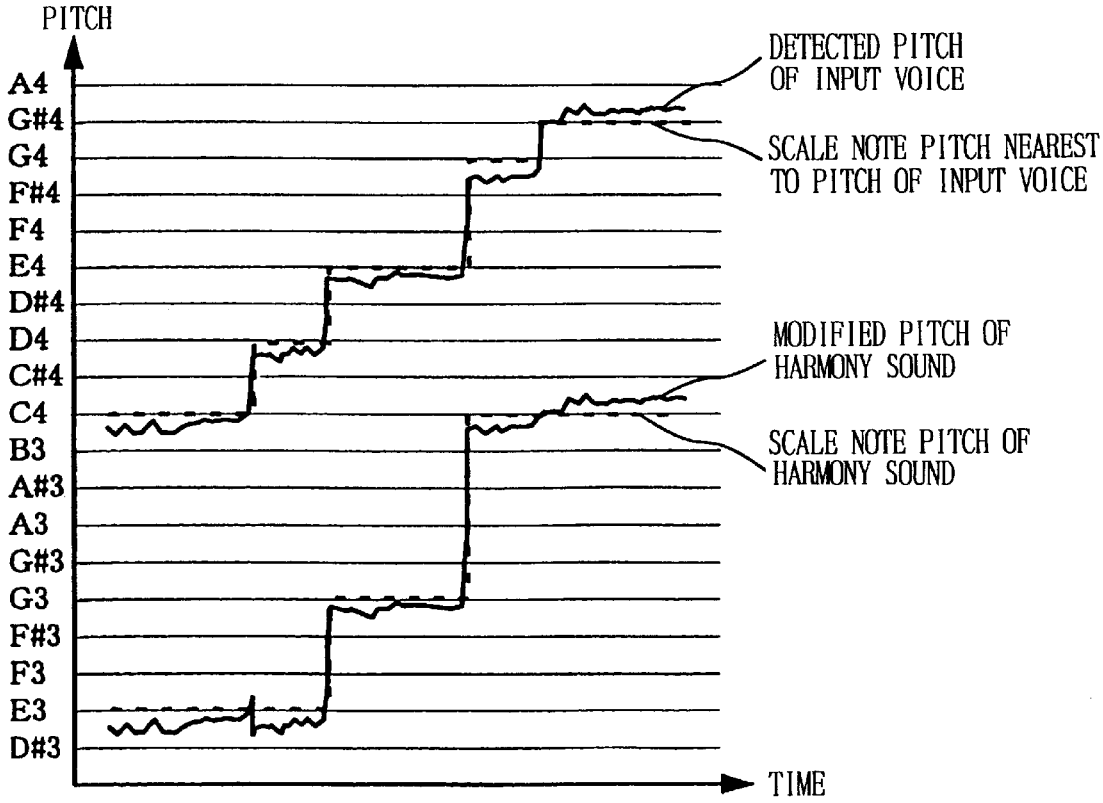
FIG. 3 is a diagram explanatory of an example of a pitch conversion operation in accordance with the first embodiment of the present invention.

FIG. 3 is a diagram explanatory of an example of the pitch conversion operation in accordance with the first embodiment of the present invention, in which the horizontal axis represents the time while the vertical axis represents the pitch. In a situation where the input voice is deviating from the predefined pitch corresponding to the scale note pitch, the instant embodiment modifies the pitch of the harmony sound in accordance with the pitch deviation amount of the input voice.

As illustrated in FIG. 2, the determination section 21 determines one of the scale note pitches which is nearest to the detected pitch of the input voice. The nearest scale note pitch is in the logarithmic value representation. As noted earlier, throughout this patent specification, the terms "scale note pitch" are used to refer to the pitch corresponding to any one of the note names on the chromatic scale. The subtracter 22 of FIG. 2 subtracts the nearest scale note pitch from the detected pitch of the input voice, to thereby calculate a pitch modification amount. The thus-calculated pitch modification amount is added, via the adder 23, to a pitch expressed in half steps and corresponding to the "scale note pitch of the harmony sound", so that the modified pitch value of the harmony sound is output from the adder 23. The modified pitch may be shifted (transposed) by further adding/subtracting a certain value to/from the modified pitch. Here, in the vocoder harmony mode, the "scale note pitch of the harmony sound" represents a scale note pitch value of a performance input to the harmony part in question or octave-shifted value of the scale note pitch. In the chordal mode, the "scale note pitch of the harmony sound" represents a combination of the scale note pitch nearest to the input voice and one or more scale note pitches determined on the basis of designation of a chord.

As shown in FIG. 3, a given frequency ratio is maintained between the pitches of the input voice and harmony sound, irrespective of fluctuations of the input voice, unless the scale note pitch nearest to the pitch of the input voice and the scale note pitch of the harmony sound change, so that there can be generated harmony sounds appropriately harmonizing with the user-input voices.

However, if the pitch of the input voice deviates from the corresponding correct scale note pitch written on a musical score by more than ±50, the nearest scale note pitch will also substantially vary from the correct scale note pitch. In such a case, the pitch modification will be performed in an incorrect manner in the vocoder harmony mode; however, the above-mentioned given frequency ratio is still maintained between the pitches of the input voice and harmony sound. In the chordal harmony mode, there will be generated an incorrect harmony sound or sounds in response to the incorrect pitch of the melody singing voice; however, the above-mentioned given frequency ratio can still be maintained between the pitches of the input voice and harmony sounds.

It is to be understood that in the vocoder harmony mode, a performance part of an automatic performance track or external input equipment, rather than the left-hand or right-hand key region, may be assigned as the harmony part, i.e., means for designating a pitch of a harmony sound.

Further, a given song track in the automatic performance mode, rather than a chord key region in the automatic performance mode, may be assigned to chord designation in such a way that inputting a chord contained in the data of the song track can impart a chordal harmony corresponding to a progression of the music piece.

It is not always necessary that the lead sound corresponding to the original input voice sung into the microphone 1 be output through the speakers of the vocal signal/tone signal processing apparatus of the invention. Namely, the user-input voice may be delivered directly to the audience in some case, or may be output through different audio amplifiers in another case. The way of outputting the pitch of the harmony sound is not necessarily limited to that based on the arithmetic operations as shown in FIG. 2. For example, a modified pitch of the harmony sound may be provided by referring to a predetermined pitch conversion table on the basis of the detected pitch of the input voice and scale note pitch of the harmony sound to be generated.

Figure 4:
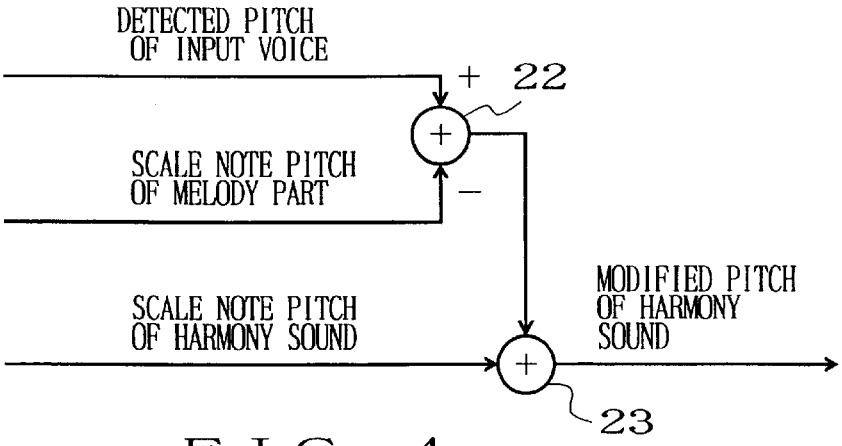
FIG. 4 is a diagram explanatory of an example of a process for determining a pitch of a harmony sound in accordance with a second embodiment of the present invention.

FIG. 4 is a diagram explanatory of an example of a process for providing the pitch of the harmony sound in accordance with a second embodiment of the present invention. This process is also performed within the pitch control section 9. In FIG. 4, the same elements as in FIG. 2 are represented by the same reference characters.

Figure 5:
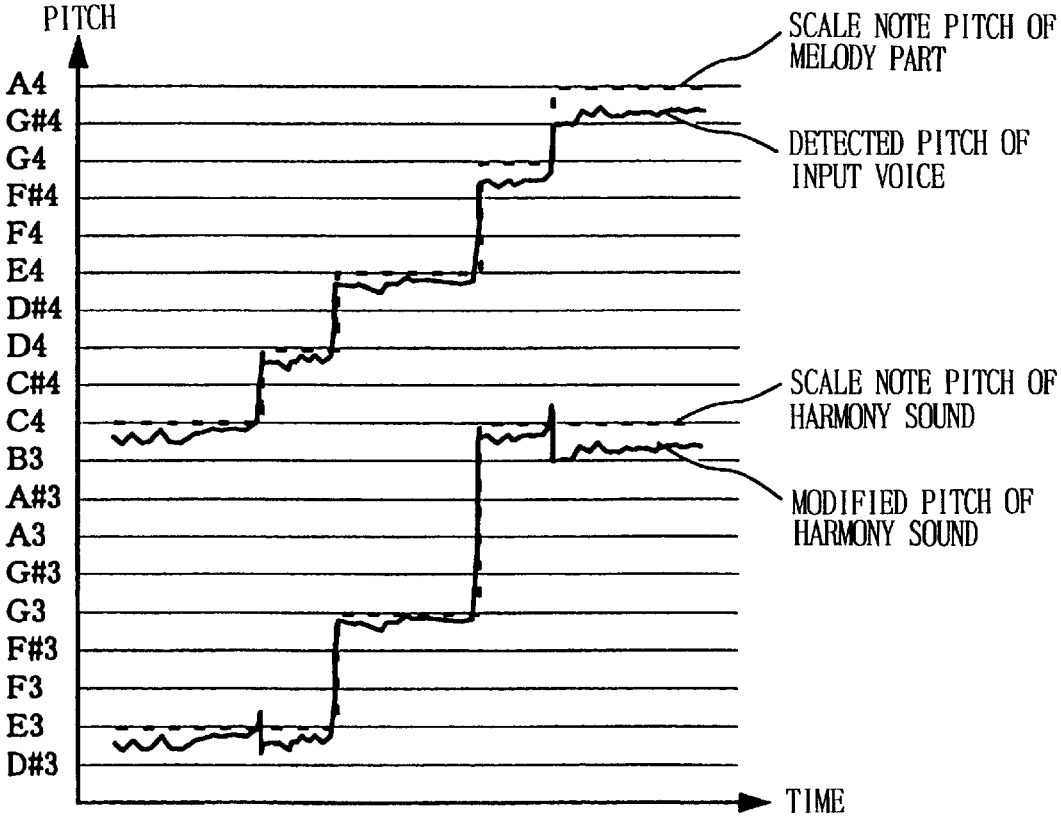
FIG. 5 is a diagram explanatory of an example of a pitch conversion operation in accordance with the second embodiment of the present invention.

FIG. 5 is a diagram explanatory of a pitch conversion operation in accordance with the second embodiment of the present invention, in which the horizontal axis represents the time while the vertical axis represents the pitch. The second embodiment is intended to set a melody part that provides a reference pitch for each user-input voice. For this purpose, the user operates the operation panel 5 of FIG. 1 so as to cause performance data, providing a reference of pitches to be sung by the user, to be input as performance data of the melody part. The user sings while paying attention to minimize pitch differences of his or her singing voices from the scale note pitches of the melody part. For example, the user may sing while playing the melody with the right-hand key region assigned as the melody part. If the left-hand key region is also assigned as the harmony part in the vocoder mode, the pitch of a depressed key in the left-hand key region on the keyboard performance operator section 2 or pitch octave-shifted from the pitch of the depressed key is designated as a harmony sound. Further, in the chordal mode, a scale note pitch of at least one harmony sound is designated in accordance with a chord designated via one or more depressed keys in the automatic accompaniment key group in the left-hand key region of the keyboard performance operator section 2 and a scale note pitch of the melody part designated via a key in the right-hand key region of the keyboard performance operator section 2. In this case too, the pitches of the input voices would fluctuate or deviate from those of keys on the keyboard performance operator section 2 depressed for the melody part rather than always coinciding with the latter. Thus, the pitches of the input voice and corresponding harmony sound do not harmonize well even when they are both within a same given period.

Subtracter 22 in the illustrated example of FIG. 4 subtracts the scale note pitch of the melody part from the detected pitch of the input voice. The pitch difference thus calculated by the subtracter 22 is passed to an adder 23 for addition to the scale note pitch of the harmony sound, so that there can be obtained a modified pitch of the harmony sound. As a consequence, a given frequency ratio depending on the current scale note pitches of the melody part and harmony part or designated chord is established between the pitches of the harmony sound and input voice, so that there can be generated harmony sounds appropriately harmonizing with the singing voices of the user. Note that it is not always necessary to generate tones corresponding to the above-mentioned performance inputs to the melody part. Namely, as compared to the first embodiment where the determination section 21 identifies the scale note pitch nearest to each input voice pitch, scale note pitches of the melody are also inputted for processing in accordance with the second embodiment. The performance inputs to the melody part may be used only for the purpose of designating reference scale note pitches for the input voices.

Whereas the right-left key region of the keyboard performance operator section 2 has been described above as being assigned as the melody part, there may be used performance data of the automatic performance track having a melody performance recorded thereon or performance data supplied from external input equipment. This approach is suitable for use with a karaoke apparatus because the user himself (or herself) does not manually play a musical instrument; in this case, the user may designate a harmony part or a chord on the keyboard performance operator section 2 on the real-time basis. Further, instead of the performance data of the harmony part or chord-designating accompaniment part being generated through a manual performance, there may be employed performance data of the accompaniment part reproduced from the automatic performance track or performance data generated from external input equipment so that such performance data are reproduced in synchronaztion with the performance data of the melody part to be automatically performed. In this second embodiment too, the modified pitch may be shifted (transposed) by further adding/subtracting a certain value to/from the modified pitch. Further, a pitch conversion table may be used in place of the arithmetic operations.

The setup shown in FIG. 1 may be implemented by a dedicated hardware apparatus or by a general-purpose processor device such as a computer.

Figure 6:
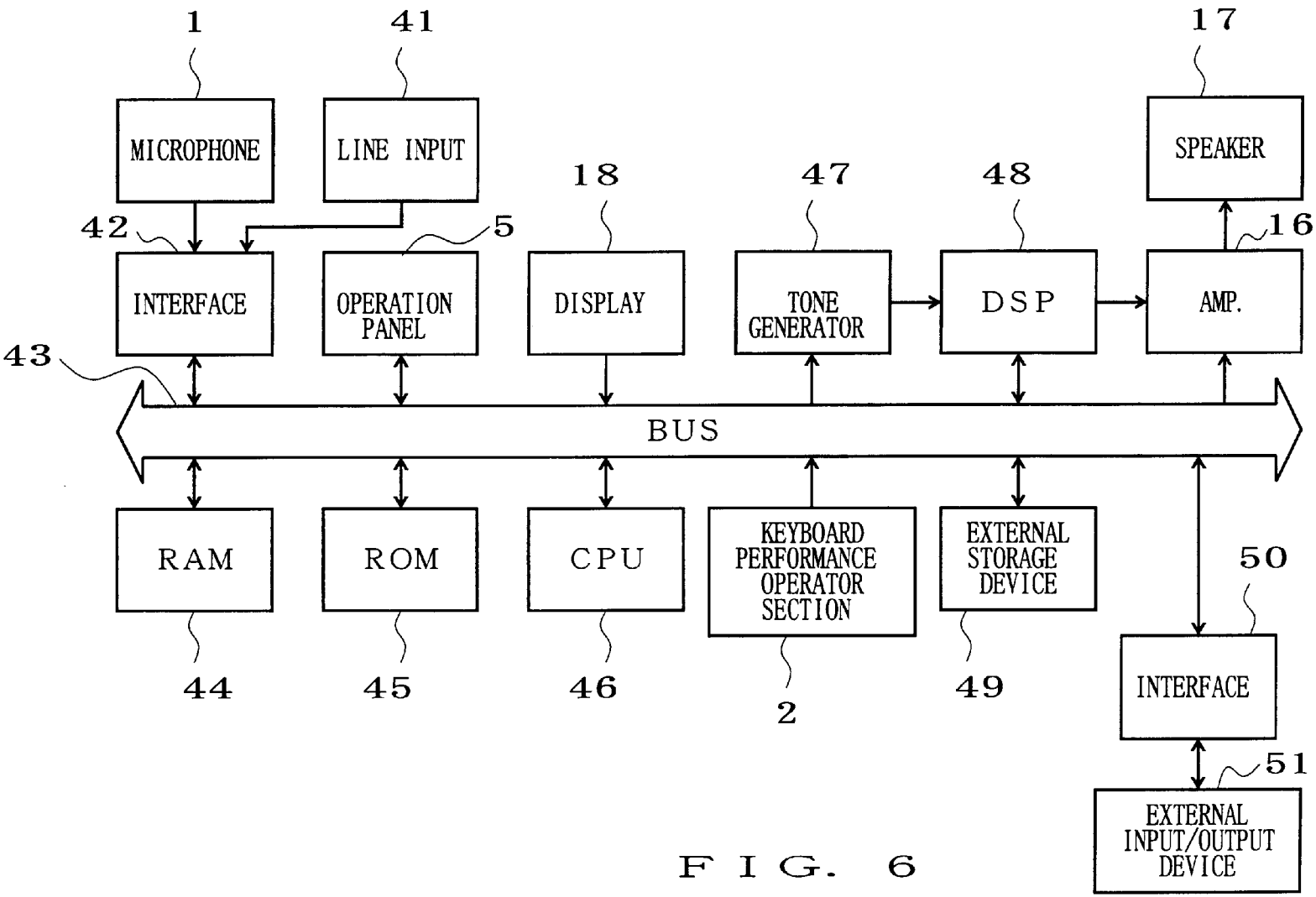
FIG. 6 is a block diagram showing an exemplary hardware setup where the embodiment of FIG. 1 is practiced by a general-purpose processor device.

FIG. 6 is a block diagram showing an exemplary hardware setup of the vocal signal/tone signal processing apparatus in the case where the embodiment of FIG. 1 is practiced by a general-purpose device. In FIG. 6, the same elements as in FIG. 1 are denoted by the same reference numerals and will not be described here to avoid unnecessary duplication. The processing apparatus includes a line input section 41 via which vocal signals are input to the apparatus from a CD (Compact Disk) player, cassette player or the like, an analog signal interface 42, a CPU bus 43, a RAM 44, a ROM 45, a CPU 46, a tone generator section 47, a DSP 48, an external storage device 49, an interface 50, and an external input/output device 51.

Each vocal signal input via the microphone 1 or line input section 41 is fed to the analog signal interface 42 to be subjected to A/D conversion and then passed to the CPU bus 43. To the CPU bus 43 are connected a plurality of hardware components, such as the RAM 44, ROM 45 and CPU 46. Display device 18 displays menus for setting harmony and other individual parameters. In the ROM 45, there are prestored programs to be executed by the CPU 46 for processing vocal and tone signals in accordance with the present invention, waveform data and preset data, parameter conversion table, demonstration-purpose song data, etc. The RAM 44 includes working areas to be used by the CPU 46 in carrying out various operations, buffer areas to be used during parameter editing operations.

Storage media to be used in the external storage device 49, also functioning as a storage section of the automatic performance section 3 of FIG. 1, may comprise one or more of a ROM cartridge, floppy disk and the like, where are recorded numerous sets of tone color data and music piece data (song data) and additional data that are not present in the ROM 45. Where the processing apparatus of the invention is constructed to be capable of both recording and reproduction, desired song data can be recorded and reproduced to and from the storage media. The interface 50 includes a MIDI input/output terminal or RS232C terminal to carry out MIDI data transmission between the processing apparatus and the external input/output device 51 of MIDI equipment such as a MIDI keyboard or sequencer, tone generator device having a tone data reproduction function, personal computer or the like.

The tone generator section 47, which does not necessarily corresponds to the block of the tone generator section 12 of FIG. 1, receives tone parameters from the CPU bus 43 to generate a tone signal based on the received parameters. The DSP 48, under the control of the CPU 46, performs formant modification, pitch detection, pitch conversion, etc. of each input vocal signal from the microphone 1 or line input section 41 and also imparts effects, such as reverberation or chorus, to the input vocal signal and tone signal. At least one or some of the functions of the tone generator section 47 and DSP 48 may be performed by software run by the CPU 46. Note that the pitch detection and conversion of the input vocal signal and the effect impartment to the output signal may be performed by separate DSPs. Each output signal (vocal or tone signal) from the DSP 48 is converted into analog representation via a D/A converter (not shown) and then sounded by the speakers 17 via the amplifiers 16.

The CPU 46 performs necessary processing on each of the input vocal signal from the microphone 1 or the like, performance operation information from the keyboard performance operator section 2 and operation panel 5 and performance data from the external storage device 49 or external input/output device 51 by use of the RAM 44 and ROM 45, displays various setting menus on the display device 18, controls the tone generator section 47, DSP 48 and amplifier 16 on the basis of the processed performance data, and outputs MIDI data to the outside via the interface 50. Regarding the performance data, sequence data, such as SMFs (Standard MIDI Files), may be stored in the external storage device 49 or, in some case, in the external input/output device 51.

The vocal signal/tone signal processing apparatus of the present invention can be implemented not only by the dedicated hardware setup of FIG. 6, but also by a personal computer including a digital-to-analog converter (DAC) and a CODEC driver installed therein and arranged to execute the program for processing the vocal or tone signals under the control of the CPU and operating system (OS). This vocal signal/tone signal processing program is supplied via a communications line, CD-ROM or other storage medium and then stored into a hard disk of the personal computer.

Figure 7:
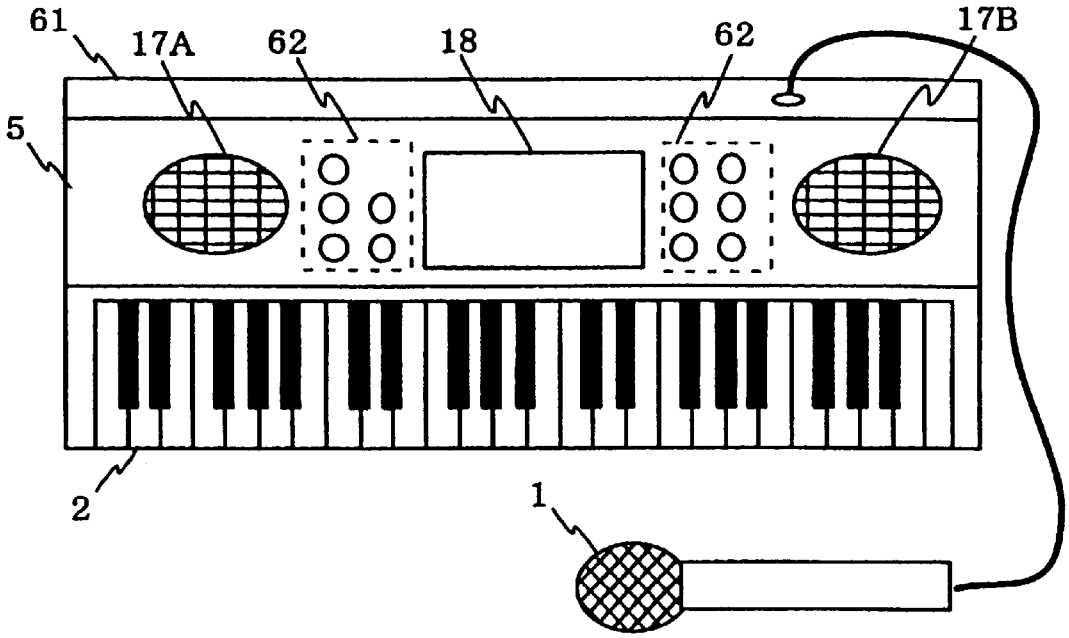
FIG. 7 is an external view of a musical instrument to which is applied the embodiment of FIG. 6.

FIG. 7 is an external view of an electronic musical instrument to which the processing apparatus of FIG. 1 is applied. In this figure, the same elements as in FIG. 1 or 6 are denoted by the same reference numerals and will not be described to avoid unnecessary duplication. In FIG. 7, reference numeral 61 represents the body of the electronic musical instrument, 62 operator group, 17A the left speaker, and 17B the right speaker.

The body of the electronic musical instrument 61 includes the keyboard performance operator section 2 having a plurality of the keys, and the left and right speakers 17A and 17B. The operation panel 5 includes the operator group 62 and display device 18. The keys of the keyboard performance operator section 2 and the other operators are shown in the figure only conceptually, and the shape and number of these keys and operators are not limited to those illustrated in the figure and may of course be chosen as desired. Among the operators directly related to the present invention are a switch for turning on/off output of a vocal harmony (i.e., a combination of a lead sound signal and harmony sound signal), a switch for turning on/off impartment of a reverberation effect to a vocal harmony, and switches for turning on/off impartment of other effects than the reverberation effect. The operators also include switches each for turning on/off impartment of an effect to an input voice, switches each for turning on/off impartment of an effect to a tone signal, vocal harmony switches for making settings of a vocal harmony, a pair of "BACK" and "NEXT" switches for switching between setting menus, and a pair of "+" and "−" switches.

Although not specifically shown in FIG. 7, the electronic musical instrument body 61 also includes slots for insertion of a ROM cartridge and FD, MIDI terminals, RS232C terminal, pitch-bend wheel, modulation wheel, etc.

The panning control section 15 shown in FIG. 1, which sets sound image localization, controls a volume ratio between vocal or tone signals to be output through the left and right speakers 17A and 17B to thereby individually control respective localized positions of the vocal sound, harmony sound and tone. The panning control is one sort of effect impartment. There has been conventionally known a so-called "random panning" technique which, as a sort of sound effect impartment operation, localizes a tone signal in a random fashion; in this case, tone signals played one after another by a particular human player are caused to be heard in sequentially-changing directions by the sound localization being switched every key depression such that they can be heard here and there, e.g., from the right, next from the left and so on. There may be provided parameters for applying such a random panning effect to individual vocal signals or tone signals.

Figure 8:
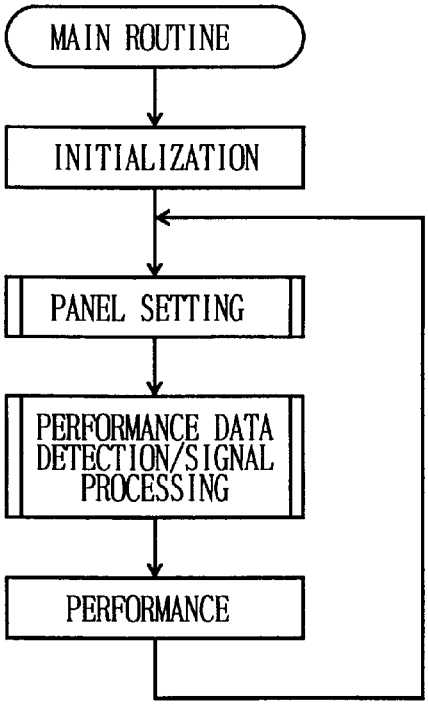
FIG. 8 is a flow chart of a main routine carried out by the embodiment of FIG. 6, which is explanatory of behavior of the processing apparatus of FIG. 6.
Figure 9:
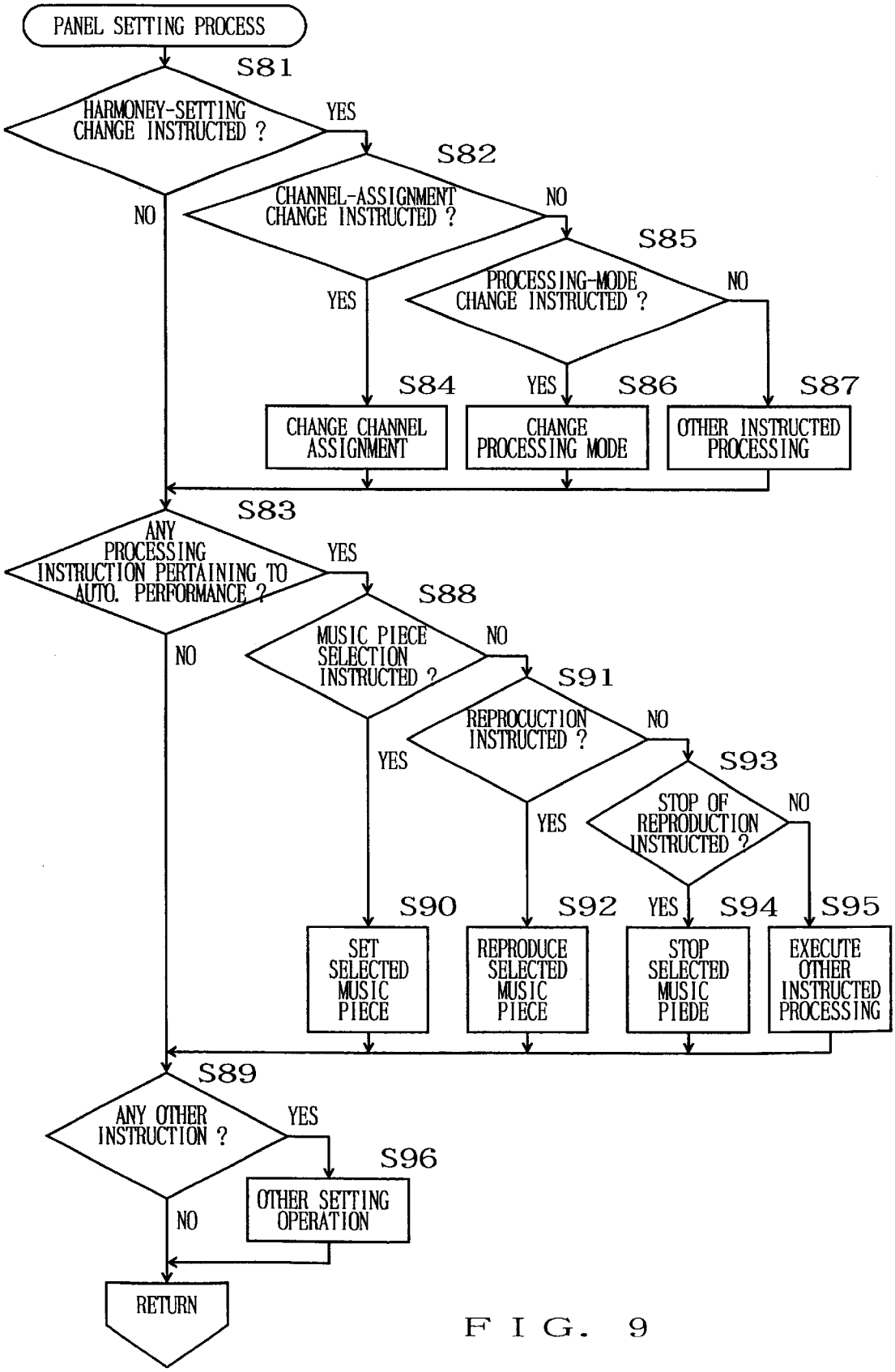
FIG. 9 is a flow chart of a panel setting process carried out by the embodiment of FIG. 6.
Figure 10:
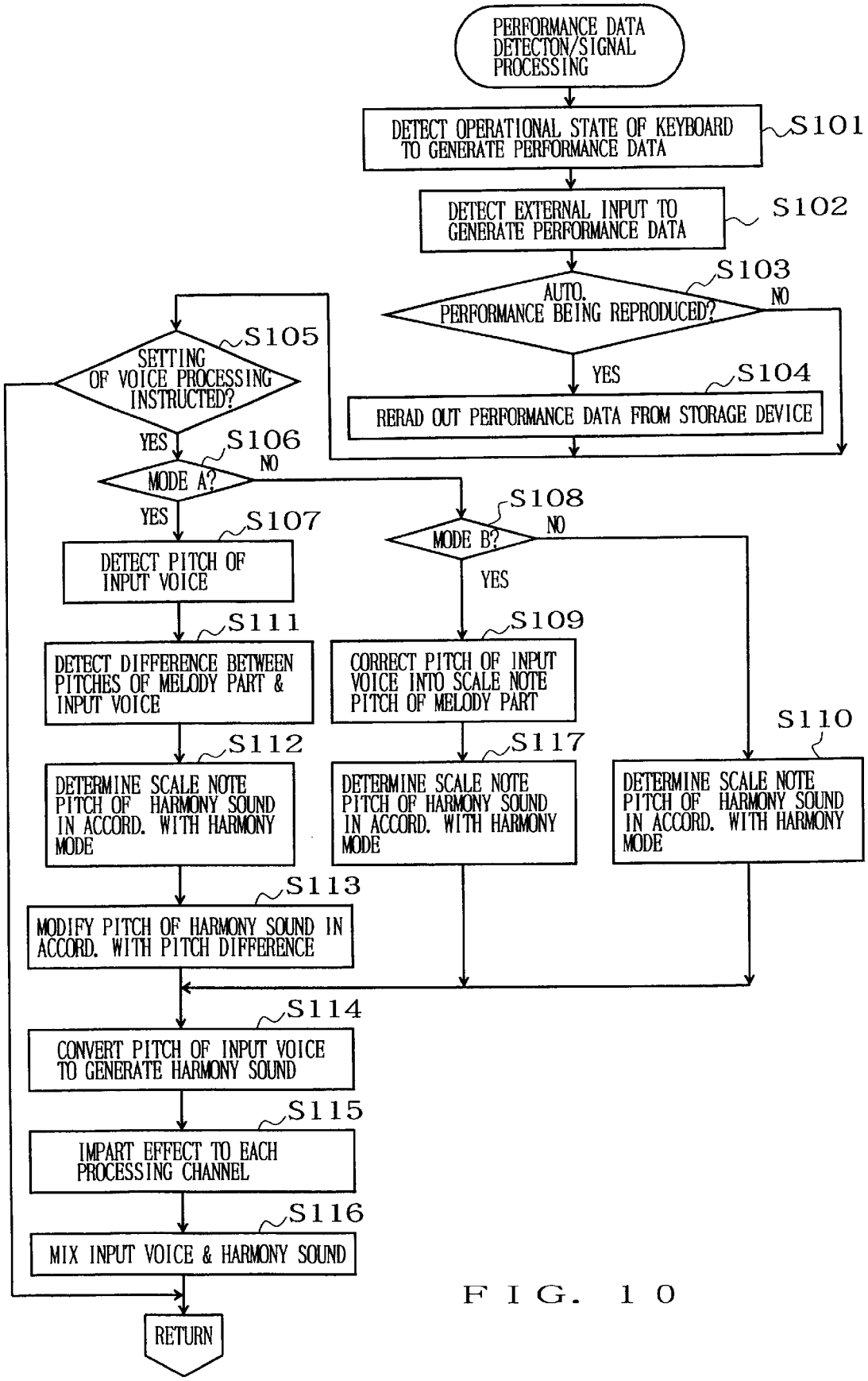
FIG. 10 is a flow chart of a performance data detection/signal processing process carried out by the embodiment of FIG. 6.

FIGS. 8 to 10 are flow charts of various processes, which are explanatory of behavior of the inventive vocal signal/tone signal processing apparatus.

FIG. 8 is a flow chart of a main routine carried out by the processing apparatus of the invention. The processing apparatus is initialized at step S71, and various necessary performance settings are made on the operation panel at next step S72. Specifically, entry of various control information, setting of various parameters, etc. are performed, using the operators 62 shown in FIG. 7 while switching between display screens on the display device 18 as necessary. The operation of step S72 (i.e., panel setting process) will be described more fully with reference to FIG. 9. At next step S73, a performance data detection/signal processing process is performed, which will be described more fully with reference to FIG. 10.

At step S74, a performance is carried out. Here, a lead sound, harmony sound and tone are performed on the basis of the various input control information and parameters set at step S72. Namely, a lead sound signal, harmony sound signal and tone signal are generated on the basis of 1) performance data corresponding to key depression on the keyboard performance operator section 2, 2) automatic performance data input from the external storage device 49 or MIDI data input from the external input/output device 51 and 3) performance input, such as a vocal or tone signal, from the microphone 1 or line input section 41, and in accordance with the control mode and parameters set on the operation panel 5. The thus-generated lead sound signal, harmony sound signal and tone signal are passed to the amplifiers 16 and then audibly produced (i.e., sounded) through the speakers 17 as tone and vocal sound signals. Depending on the performance data generated in response to the key depression on the keyboard performance operator section 2, the vocal sound signal, made up of the lead sound signal and harmony sound signal, can be sounded while maintaining the original form of the input vocal signal, or sounded with a change in the tone color, particularly in the vocal character or gender (e.g., from the female voice to the male voice or from the male voice to the female voice) and/or a change in the pitch.

Upon completion of the operation at step S74, the main routine loops back to step S72 to repeat the operations of steps S72 to S74.

FIG. 9 is a flow chart of the panel setting process carried out at step S72 of the main routine. At step S81, a determination is made as to whether or not there has been given a harmony-setting change instruction. If there has been such a harmony-setting change instruction as determined at step S81, the process branches to step S82; otherwise, i.e., with a negative determination, the process moves on to step S83.

At step S82, it is determined whether or not there has been given an instruction for changing the assignment of a melody channel or harmony channel. If there has been such a channel-assignment change instruction as determined at step S82, the process moves on to step S84; otherwise, the process branches to step S85. At step S84, the assignment of the melody channel or harmony channel is changed as instructed; in this case, it is also possible to assign not only a channel for a MIDI signal from the keyboard or external equipment but also an automatic performance track. At step S85, a determination is made as to whether or not there has been a processing-mode change instruction. If there has been such a processing-mode change instruction as determined at step S85, the process moves to step S86; otherwise, the process branches to step S87.

At step S86, a new setting is made as to how the input voice should be processed to output lead and harmony sounds. Specifically, a change is made between processing modes A to C. Processing mode A is a novel processing mode newly employed in the above-described embodiment of the present invention, while processing modes B and C are conventionally-known processing modes. In processing mode A, the lead sound is set to the same pitch as the original input voice, while the harmony sound, generated in accordance with the currently-designated harmony mode, is modified in pitch in accordance with a pitch deviation of the original input voice.

In processing mode B, the pitch of the original input voice is corrected to correspond to the scale note pitch nearest to the input voice pitch, so as to provide a lead sound of the corrected pitch. Namely, when the pitch of the original input voice has a certain deviation, it is modified into the correct scale note pitch. The harmony sound is generated in accordance with the currently-designated harmony mode. Because the pitch of the original input voice has been corrected to correspond to the nearest scale note pitch defined on the half-step basis, there is no need, in this case, to modify the pitch of the harmony sound. In processing mode C, the lead sound is set to the same pitch as the original input voice, while the harmony sound is generated in accordance with the currently-designated harmony mode without the difference between the pitches of the harmony sound and original input voice being taken into account.

At step S87 taken from a negative determination at step S85, other instructed processing is carried out.

At step S83, a determination is made as to whether or not there has been an processing instruction pertaining to an automatic performance. If there has been such a processing instruction as determined at step S83, the process branches to step S88; otherwise, the process moves on to step S89. At step S88, a determination is made as to whether or not there has been an instruction for selecting a music piece. If there has been such an instruction as determined at step S88, the process goes to step S90; otherwise, the process branches to step S91. The selected music piece (song) is set for an automatic performance at step S90, and then the process moves on to step S89. Note that at the time of turning the power on, a change is made from the last music piece to the newly-selected music piece because the data of the last-selected music piece still remain set in the processing apparatus. Also, note that the music piece data are read out from the ROM 45 or external storage device 49 of FIG. 6 and loaded into the RAM 44.

At step S91, a determination is made as to whether or not there has been given an instruction for reproducing the performance data of the selected music piece data. If there has been such a reproduction instruction as determined at step S91, the process moves on to step S92; otherwise, the process branches to step S93. Reproduction of the performance data of the selected music piece is started at step S92, and then the process proceeds to step S89. At step S93, a determination is made as to whether or not there has been given an instruction for stopping the reproduction. If there has been such a reproduction stop instruction as determined at step S93, the process moves on to step S94; otherwise, the process branches to step S95. The automatic performance being reproduced is stopped at step S94, and then the process proceeds to step S89. At step S95, other instructed processing is carried out, such as fast forwarding, winding or editing. After step S95, the process proceeds to step S89. At step S89, it is further determined whether or not there has been any setting instruction other than those for the above-mentioned harmony setting and automatic performance, such as an instruction for effect setting or tone color change. With an affirmative determination at step S89, the process goes to step S96 to make the instructed other setting, while with a negative answer, the process returns to the main routine of FIG. 8.

FIG. 10 is a flow chart of the performance data detection/signal processing process performed in the embodiment of the present invention.

At step S101, a detection is made of the current operational state of the keyboard performance operator section 2 so as to generate performance data designating a scale note pitch in accordance with the detected result. Then, at step S102, MIDI performance data are introduced via the external input terminal from a sequencer, personal computer, electronic musical instrument or the like. At next step S103, a determination is made as to whether any automatic performance is now being reproduced. If answered it in the affirmative at step S103, the performance data detection/signal processing process moves on to step S104, but if answered in the negative, the process jumps to step S105. At step S104, the performance data stored in the SMF or other format in the external storage device are read out, after which the process goes to step S105. At step S105, a further determination is made as to whether there has been given an instruction for setting voice processing. If there has been such an instruction, the process proceeds to step S106, but if not, the process returns to the main routine.

At and after step S106, the voice processing is carried out in accordance with any one of processing modes A, B and C. For simplicity of description, the voice processing will be described assuming that the currently-designated harmony mode is the vocoder harmony mode or chordal harmony mode and that user-input voices are sung on the basis of scale note pitches of the melody part and then processed on the basis of the scale note pitches of the melody part. At step S106, it is determined whether or not processing mode A is currently designated. If so, the process goes to step S107; otherwise, the process branches to step S108. At step S108, it is further determined whether processing mode B is currently designated. If processing mode B is currently designated as determined at step S108, the process goes to step S109; otherwise, it is determined that processing mode C is currently designated and the process branches to step silo.

Steps S107 and S111 to S116 are taken when processing mode A is currently designated. At step S107, detection is made of the pitch of the input voice from the microphone or line input section. Then, at step S111, a difference is detected between the scale note pitch of the melody part and the detected pitch of the input voice. At next step S112, a scale note pitch of a harmony sound is determined in accordance with the currently-selected or designated harmony mode. Namely, in the vocoder harmony mode, the scale note pitch of the harmony sound is determined in accordance with the scale note pitch of the harmony part or scale note pitch octave-shifted from the harmony part scale note pitch. In the chordal mode, the scale note pitch of each harmony sound is determined in accordance with the harmony type, chord designated in the harmony part and scale note pitch of the harmony part.

At next step S113, the pitch of each harmony sound is modified in accordance with the pitch difference of the input voice. Then, at step S114, the input voice is subjected to pitch conversion so that its pitch equals the pitch of the harmony sound modified at step S113, and thus the harmony sound is generated on the basis of the input voice. Note that if the pitch conversion scheme as described above in relation to FIG. 1 is used for the pitch conversion of the input voice, it is not necessarily necessary to know the pitch of the original input voice. At step S115, effects are imparted to the processing channels of the input voice and harmony sound, and then at step S116, the input voice (lead sound) and harmony sound are combined together, after which the process returns to the main routine.

In processing mode B, the pitch of the input voice is corrected into the scale note pitch of the melody part at step S109, and then the scale note pitch of the harmony sound is determined in accordance with the currently-designated harmony mode, after which the process moves on to step S114 to perform the operations at and after step S114.

Note that while the vocoder harmony mode is selected in processing mode A and unless there is no performance input from the harmony part, the operations of steps S107 to S114 may be skipped so as to reduce the processing loads on the CPU. Namely, the detection of the pitch of the input vocal of step S107 is suspended. Further, note that once a chord is designated in the chordal harmony mode, the conventionally-known technique sustains the designated chord till a next chord change. Alternatively, in the present invention, the operations of steps S107 to S114 may be skipped during a time period when no chord-designating key depression is being made, in such a case where arrangements are made for generating a harmony sound only when chord-designating key depression data is being output from the harmony part.

Whereas the embodiments of the present invention have been described in relation to the case where the sound input to the microphone 1 or line input section 41 is a vocal signal sung by the user, the sound input to the microphone 1 or line input section 41 may be a music tone signal or other type of sound signal as long as the pitch of the input signal is detectable. Even MIDI data having an note event and bend/pitch control data may be used as the input sound data input to line input section 41 or the like. Further, the sound signal input to the microphone 1 or line input section 41 may be in analog form rather than in digital form. In the event that a sound signal accompanied by pitch information is input via a line from external equipment, it is possible to omit the operation for detecting the pitch of the input sound signal.

Furthermore, although the harmony sound has been described above as having the same sound quality (vocal character) as the input signal or having a gender-controlled sound quality (voice character) and as being obtained by processing the waveform of the input voice, it may be imparted with a different instrument tone color from the input voice. According to a first approach for the impartment of such a different instrument tone color, a separate tone signal waveform is provided, and this tone signal waveform is pitch-converted using a pitch conversion scheme similar to the scheme described above. According a second approach for the impartment of the different instrument tone color, the different instrument tone color is output from the tone generator section 12. More specifically, the second approach generates the harmony sound using the so-called "pitch-to-note" technique which has heretofore been applied to the original input voice so as to generate a tone with the pitch of the input voice. With this second approach, the harmony sound generated can have a less disagreement with the input voice if a chorus tone color is selected as the tone color of the tone.

The vocal signal/tone signal processing apparatus of the present invention can be advantageously applied to various equipment having a function of receiving vocal or tone signals, such as amusement equipment like electronic musical instruments, game machines and karaoke apparatus, a variety of household electrical appliances such as TV sets, communications equipment such as cellular phones, and personal computers. Namely, the processing apparatus of the present invention can be used advantageously as a vocal signal/tone signal processing section in these pieces of equipment.

In summary, as apparent from the foregoing, the present invention can generate additional sound signals rich in variations while appropriately retaining harmony with input vocal signals. The present invention also attain appropriate harmony between lead and harmony sounds with a subtle pitch deviation of the input voice left unremoved. As a result, even a user not so good at singing can sing a harmony which is pleasing to the ear of every listener and also produce a harmony sound with a warm human touch by positively utilizing a subtle pitch deviation of the user-input voice.

What is claimed is:

1. An apparatus for generating an additional sound signal on the basis of an input sound signal, said apparatus comprising: an input device adapted to receive control information for controlling a pitch of an additional sound, said control information including information indicative of a scale note pitch of the additional sound to be generated; and a processor device coupled with said input device and adapted to:

obtain pitch information of the input sound signal;

obtain, on the basis of at least the control information received via said input device, scale note pitch information of the additional sound to be generated;

determine a scale note pitch nearest to a pitch indicated by the pitch information of the input sound signal;

modify, in accordance with a difference between the determined scale note pitch and the pitch of the input sound signal, a pitch indicated by the scale note pitch information of the additional sound to be generated; and generate an additional sound signal with the modified pitch.

2. An apparatus as claimed in claim 1 wherein the additional sound signal is generated with a waveform characteristic of the input sound signal.

3. An apparatus as claimed in claim 1 wherein said processor device obtains the pitch information of the input sound signal by detecting the pitch of the input sound signal.

4. An apparatus as claimed in claim 1 wherein the control information received via said input device includes chord information, and said processor device obtains, on the basis of the chord information, the scale note pitch information of the additional sound to be generated.

5. An apparatus as claimed in claim 1, which further comprises a performance data supplying device adapted to supply first and second tone data being stored in a memory in such a manner that said first and second tone data are synchronously reproduced, and wherein said input device receives said second tone data as said control information, and wherein said processor device determines said scale note pitch nearest to a pitch of the input sound signal on the basis of a pitch of said first tone data.

6. An apparatus as claimed in claim 1, which further comprises a tone data supplying device adapted to supply first tone data being stored in a memory, and wherein said input device receives second tone data as said control information, said second tone data being generated and received on the real-time basis, and wherein said processor device determines said scale note pitch nearest to a pitch of the input sound signal on the basis of a pitch of said first tone data.

7. An apparatus as claimed in claim 1, which further comprises a tone data supplying device adapted to supply first tone data being stored in a memory, and wherein said input device receives second tone data as said control information, and wherein said processor device further adapted to modify the first tone data and modify the second tone data in accordance with the modification of the first tone data, and wherein said processor device obtains, on the basis of the modified second tone data, the scale note pitch information of the additional sound to be generated, and wherein said processor device determines said scale note pitch nearest to a pitch of the input sound signal on the basis of a pitch of the modified first tone data, and wherein said processor device modifies, in accordance with the difference between the determined scale note pitch and the pitch of the input sound signal, the pitch indicated by the scale note pitch information of the additional sound to be generated; and wherein said additional sound signal is generated on the basis of said input sound signal by changing at least the pitch of said input sound signal to the modified pitch of the additional sound to be generated.

8. An apparatus as claimed in claim 1, wherein said input device receives tone data as said control information, and wherein said processor device obtains, on the basis of the received tone data, the scale note pitch information of the additional sound to be generated, and wherein said processor device adapted to perform a processing for detecting a tone pitch of said input sound signal so as to obtain said pitch information of the input sound signal, and wherein said processor device further adapted to suspend said processing for detecting a tone pitch of said input sound signal when there is no said tone data received by said input device.

9. An apparatus as claimed in claim 1, which further comprises a performance data supplying device adapted to supply first and second tone data, and wherein said apparatus has an operation mode in which another additional sound signal is generated, and wherein, when said operation mode is selected, said processor device adapted to generate a first signal which is a signal obtained by changing a pitch of the input sound signal to a pitch of the first tone data, and generate a second signal which is a signal obtained by changing a pitch of the input sound signal to a pitch of the second tone data, said another additional sound signal being generated on the basis of said second signal.

10. An apparatus as claimed in claim 1, wherein said additional sound signal generated by said processor device is mixed with a signal based on said input sound signal and the mixed signal are audibly sounded.

11. An apparatus as claimed in claim 1, wherein said processor device further adapted to modify, in accordance with the modified pitch of the additional sound to be generated, a pitch of said input sound signal.

12. An apparatus for generating an additional sound signal on the basis of an input sound signal, said apparatus comprising:

a data supply section adapted to supply scale note pitch data varying over time;

an input device adapted to receive control information for controlling a pitch of an additional sound, said control information including information indicative of a scale note pitch of the additional sound to be generated; and a processor device coupled with said data supply section and said input device, said processor device being adapted to:

obtain pitch information of the input sound signal;

obtain, on the basis of at least the control information received via said input device, scale note pitch information of the additional sound to be generated;

modify, in accordance with a difference between a pitch indicated by the pitch information of the input sound signal and a pitch indicated by the scale note pitch data supplied by said data supply section, a pitch indicated by the scale note pitch information of the additional sound to be generated; and generate an additional sound signal with the modified pitch.

13. An apparatus as claimed in claim 12 wherein the input sound signal is a signal indicative of a song sung by a user, and said data supply section supplies standard scale note pitch data varying over time in accordance with a melody of a song.

14. An apparatus as claimed in claim 12 wherein the additional sound signal is generated with a waveform characteristic of the input sound signal.

15. An apparatus as claimed in claim 12, wherein said processor device further adapted to modify, in accordance with the modified pitch of the additional sound to be generated, a pitch of said input sound signal.

16. A method for generating an additional sound signal on the basis of an input sound signal, said method comprising the steps of:

obtaining pitch information of the input sound signal;

receiving control information for controlling a pitch of an additional sound, said control information including information indicative of a scale note pitch of the additional sound to be generated;

obtaining, on the basis of at least the control information received via said step of receiving, scale note pitch information of the additional sound to be generated;

determining a scale note pitch nearest to a pitch indicated by the pitch information of the input sound signal;

modifying, in accordance with a difference between the determined scale note pitch and the pitch of the input sound signal, a pitch indicated by the scale note pitch information of the additional sound to be generated; and generating an additional sound signal with the modified pitch.

17. A method for generating an additional sound signal on the basis of an input sound signal, said method comprising the steps of:

obtaining pitch information of the input sound signal;

supplying scale note pitch data varying over time;

receiving control information for controlling a pitch of an additional sound, said control information including information indicative of a scale note pitch of the additional sound to be generated;

obtaining, on the basis of at least the control information received via said step of receiving, scale note pitch information of the additional sound to be generated;

modifying, in accordance with a difference between a pitch indicated by the pitch information of the input sound signal and a scale note pitch indicated by the scale note pitch data supplied via said step of supplying, a pitch indicated by the scale note pitch information of the additional sound to be generated; and generating an additional sound signal with the modified pitch.

18. A machine-readable storage medium containing a group of instructions to cause said machine to implement a method for generating an additional sound signal on the basis of an input sound signal, said method comprising the steps of:

obtaining pitch information of the input sound signal;

receiving control information for controlling a pitch of an additional sound, said control information including information indicative of a scale note pitch of the additional sound to be generated;

obtaining, on the basis of at least the control information received via said step of receiving, scale note pitch information of the additional sound to be generated; determining a scale note pitch nearest to a pitch indicated by the pitch information of the input sound signal;

modifying, in accordance with a difference between the determined scale note pitch and the pitch of the input sound signal, a pitch indicated by the scale note pitch information of the additional sound to be generated; and generating an additional sound signal with the modified pitch.

19. A machine-readable storage medium containing a group of instructions to cause said machine to implement a method for generating an additional sound signal on the basis of an input sound signal, said method comprising the steps of:

obtaining pitch information of the input sound signal;

supplying scale note pitch data varying over time;

receiving control information for controlling a pitch of an additional sound, said control information including information indicative of a scale note pitch of the additional sound to be generated;

obtaining, on the basis of at least the control information received via said step of receiving, scale note pitch information of the additional sound to be generated;

modifying, in accordance with a difference between a pitch indicated by the pitch information of the input sound signal and a scale note pitch indicated by the scale note pitch data supplied via said step of supplying, a pitch indicated by the scale note pitch information of the additional sound to be generated; and generating an additional sound signal with the modified pitch.

* * * * *